US009186544B1

(12) United States Patent
Kastrat

(10) Patent No.: US 9,186,544 B1
(45) Date of Patent: Nov. 17, 2015

(54) MULTI-FUNCTIONAL AND COLLAPSIBLE EXERCISE DEVICE AND ASSOCIATED USE THEREOF

(71) Applicant: Ajet Kastrat, Bronx, NY (US)

(72) Inventor: Ajet Kastrat, Bronx, NY (US)

( * ) Notice: Subject to any disclaimer, the term of this patent is extended or adjusted under 35 U.S.C. 154(b) by 48 days.

(21) Appl. No.: 14/189,993

(22) Filed: Feb. 25, 2014

Related U.S. Application Data

(60) Provisional application No. 61/768,707, filed on Feb. 25, 2013.

(51) Int. Cl.
*A63B 21/00* (2006.01)
*A63B 23/02* (2006.01)
*A63B 21/02* (2006.01)

(52) U.S. Cl.
CPC ..... *A63B 23/02* (2013.01); *A63B 21/025* (2013.01)

(58) Field of Classification Search
CPC ..... A63B 21/025; A63B 21/00; A63B 21/00003; A63B 21/00007; A63B 21/00112; A63B 21/001169; A63B 21/00512; A63B 21/00156; A63B 21/012; A63B 21/015; A63B 21/02; A63B 21/014; A63B 21/1419; A63B 21/15; A63B 21/16; A63B 21/22; A63B 22/0046; A63B 23/00; A63B 23/02; A63B 23/0205; A63B 23/0233; A63B 23/0211; A63B 2023/003; A63B 2023/006; A63B 21/023; A63B 21/0407; A63B 21/0421; A63B 21/0442; A63B 21/068; A63B 21/1457; A63B 21/1461; A63B 21/1492; A63B 2021/1609; A63B 23/0216; A63B 23/0222; A63B 23/0227
See application file for complete search history.

(56) References Cited

U.S. PATENT DOCUMENTS

| | | | | |
|---|---|---|---|---|
| 6,602,171 | B1 * | 8/2003 | Tsen et al. | 482/140 |
| 6,716,144 | B1 * | 4/2004 | Shifferaw | 482/140 |
| 7,344,486 | B2 * | 3/2008 | Casey et al. | 482/140 |
| 7,381,171 | B2 * | 6/2008 | Chen | 482/140 |
| 8,062,196 | B1 * | 11/2011 | Khubani | 482/140 |
| 2003/0050155 | A1 * | 3/2003 | Lat | 482/92 |
| 2008/0076649 | A1 * | 3/2008 | Chen | 482/140 |
| 2011/0092346 | A1 * | 4/2011 | Wakuda | 482/121 |
| 2012/0252642 | A1 * | 10/2012 | Chen | 482/121 |
| 2014/0274618 | A1 * | 9/2014 | Ho et al. | 482/140 |

* cited by examiner

*Primary Examiner* — Loan H Thanh
*Assistant Examiner* — Megan Anderson

(57) ABSTRACT

A multi-functional exercise device that can be maneuvered between a variety of configurations for facilitating a variety of targeted exercises includes a top section, a torque manipulator adjustably attached to the top section, and an intermediate section adjustably attached to the torque manipulator. Advantageously, the torque manipulator causes greater resistance to rotational movement of the top section relative to the intermediate section when the top section is rotated, along a first rotational direction, from a rested equilibrium position to a displaced tensioned position. Advantageously, the torque manipulator causes lesser resistance to rotational movement of the top section relative to the intermediate section when the top section is rotated, along a second rotational direction, from the displaced tensioned position to the rested equilibrium position.

14 Claims, 6 Drawing Sheets

MULTI-FUNCTIONAL AND COLLAPSIBLE EXERCISE DEVICE AND ASSOCIATED USE THEREOF

CROSS REFERENCE TO RELATED APPLICATIONS

This application claims the benefit of U.S. Provisional Application No. 61/768,707 filed Feb. 25, 2013, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relate to exercise devices and, more particularly, to a multi-functional and collapsible exercise device that can be assembled in a variety of configurations for facilitating a variety of targeted exercises.

2. Prior Art

Regular physical exercise is an important part of any healthy fitness routine, and also essential for maintaining and increasing an appropriate tone in one's muscular system. Taught, fit muscles provide a wide variety of both aesthetic and personal wellness benefits, helping to ensure that the bearer lives longer and enjoys life more. Achieving this muscle tautness, however, can be quite difficult for a regular person to undertake. While some muscles and muscle groups are relatively easy to isolate and effectively train, others are hard to focus on and tend to be ignored, even in most popular exercise routines.

Keeping the whole body in proper tune with itself can be both awkward and uncomfortable, and attempting to correctly work certain difficult groups of muscles without the appropriate equipment can be a surefire recipe for cramping and even injury. Good exercise equipment provides a solid frame against which the body can be worked with precision, targeting strength building to the clusters of muscle mass that need it the most, while avoiding dangerous trouble spots.

Of all the varied different groups of muscles in the body, the abdominal muscles are commonly considered the toughest to isolate and develop. Their unique position across the front of the stomach and bowels puts the abs constantly on display, making their shaping up and reformation a key fitness target of almost every personal exercise routine. Working one's abs is a serious endeavor, requiring considerable mechanical support to effectively target the majority of the exercise benefit on the ideal location of improvement. The natural impulse is to pull away to one side or the other, or to transfer some of the strain into the back, hips or legs. This type of deflecting during a workout can have serious consequences, exacerbating existing mobility conditions and occasioning the development of newer and more crippling ones. A new exercise routine, particularly one focusing on further developing such a sensitive area of the body as the abdominal cavity, should always be approved by one's personal physician before it is begun, and ideally should involve the use of specialized equipment to ensure it is being executed properly.

Accordingly, a need remains for a multi-functional and collapsible exercise device in order to overcome at least one shortcoming. The exemplary embodiment(s) satisfy such a need by providing a multi-functional and collapsible exercise device that can be assembled in a variety of configurations, is convenient and easy to use, lightweight yet durable in design, versatile in its applications, and designed for facilitating a variety of targeted exercises.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a multi-functional exercise device that can be maneuvered between a variety of configurations for facilitating a variety of targeted exercises. These and other objects, features, and advantages of the non-limiting exemplary embodiment(s) are provided by a multi-functional exercise device including a top section, a torque manipulator adjustably attached to the top section, and an intermediate section adjustably attached to the torque manipulator. Advantageously, the torque manipulator causes greater resistance to rotational movement of the top section relative to the intermediate section when the top section is rotated, along a first rotational direction, from a rested equilibrium position to a displaced tensioned position. Advantageously, the torque manipulator causes lesser resistance to rotational movement of the top section relative to the intermediate section when the top section is rotated, along a second rotational direction, from the displaced tensioned position to the rested equilibrium position.

In a non-limiting exemplary embodiment, the top section includes a back rest including a frame, a plurality of bars rotatably affixed to the frame, and a plurality of top handles rotatably mated to the frame. Such top handles are selectively articulated along mutually exclusive arcuate paths located at lateral sides of the frame.

In a non-limiting exemplary embodiment, the torque manipulator includes a dynamic top bracket having a female socket extending downwardly therefrom, a static bottom bracket having a male shaft extending upwardly therefrom, and a plurality of helical springs equidistantly offset from the female socket. In this manner, each of the helical springs has opposed top and a bottom ends fixedly attached to the top bracket and the bottom bracket, respectively. Advantageously, the helical springs are simultaneously biased and released as the top bracket is articulated, along the first rotational direction and the second rotational direction, about a first axis passing through the bottom bracket.

In a non-limiting exemplary embodiment, the helical springs are extended when biased to the displaced tensioned position and retracted when released to the rested equilibrium position.

In a non-limiting exemplary embodiment, the intermediate section includes a seat rest, a plurality of intermediate handles frictionally engaged with the seat rest, a first anchor bracket fixedly secured to an upper portion of a rear side of the seat rest, a second anchor bracket fixedly secured to a medial portion of the rear side of the seat rest, and a third anchor bracket fixedly secured to a lower portion of the rear side of the seat rest. Such intermediate handles are linearly displaced along mutually exclusive linear paths extending laterally away from the seat rest.

In a non-limiting exemplary embodiment, the intermediate section further includes a first angularly adjustable mechanism coupled to the torque manipulator, the first anchor bracket and the second anchor bracket.

In a non-limiting exemplary embodiment, the first angularly adjustable mechanism includes a first bracket hingedly coupled to the first anchor bracket and statically coupled to the torque manipulator, and a first linear guide rail statically mated to the first bracket and extending outwardly therefrom. Notably, the first linear guide rail is adjustably mated to the second anchor bracket.

In a non-limiting exemplary embodiment, the intermediate section further includes a second angularly adjustable mechanism coupled to the second anchor bracket and the third anchor bracket.

In a non-limiting exemplary embodiment, multi-functional exercise device further including: a bottom section adjustably attached to the intermediate section.

In a non-limiting exemplary embodiment, the bottom section includes a foot rest including a linearly adjustable mechanism operably connection to the second angularly adjustable mechanism.

In a non-limiting exemplary embodiment, the linearly adjustable mechanism includes a linear female section, a linear male section telescopically engaged with the linear female section, and a leg bar frame having a plurality of offset horizontal cylindrical sections attached thereto. Notably, the leg bar is frame is coupled to the linear female section.

In a non-limiting exemplary embodiment, the second angularly adjustable mechanism includes a second bracket hingedly coupled to the third anchor bracket and the linear male section, and a second linear guide rail adjustably mated to the second bracket and extending outwardly therefrom. Notably, the second linear guide rail is pivotally mated to the second anchor bracket.

In a non-limiting exemplary embodiment, the first angularly adjustable mechanism causes the back rest to articulate, relative to the top section, about a second axis disposed perpendicular to the first axis.

In a non-limiting exemplary embodiment, the second angularly adjustable mechanism causes the foot rest to articulate, relative to the back rest, about a third axis disposed perpendicular to the first axis and parallel to the second axis.

The present disclosure further includes a method of utilizing a multi-functional exercise device that can be maneuvered between a variety of configurations for facilitating a variety of targeted exercises. Such a method includes the steps of: providing a top section; providing and adjustably attaching a torque manipulator to the top section; and providing and adjustably attaching an intermediate section to the torque manipulator. The method further includes the steps of: the torque manipulator causing greater resistance to rotational movement of the top section relative to the intermediate section when the top section is rotated, along a first rotational direction, from a rested equilibrium position to a displaced tensioned position; and the torque manipulator causing lesser resistance to rotational movement of the top section relative to the intermediate section when the top section is rotated, along a second rotational direction, from the displaced tensioned position to the rested equilibrium position.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
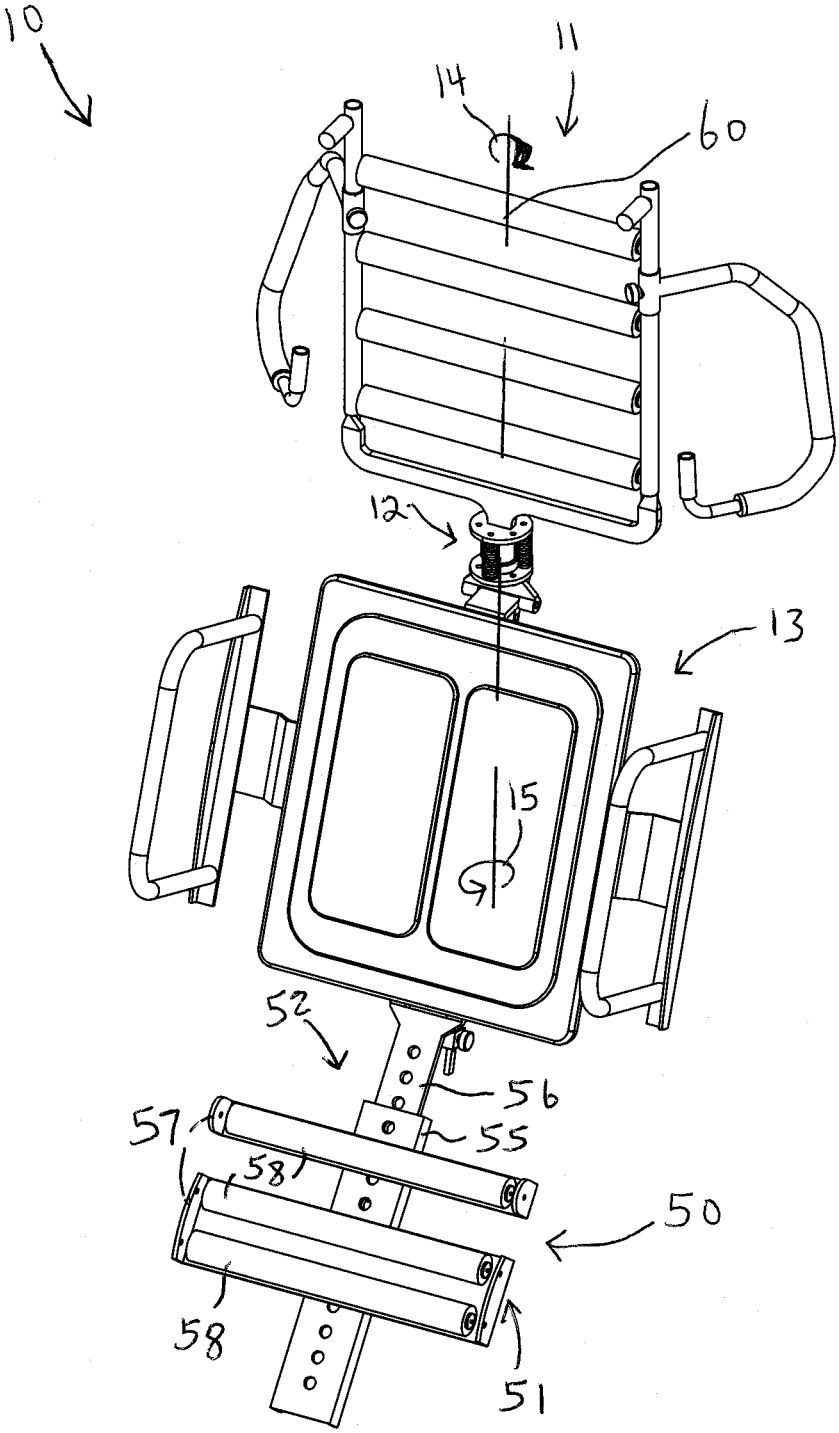
FIG. 1 is a perspective view showing a front side of a multi-functional exercise device at an expanded configuration, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

Figure 2:
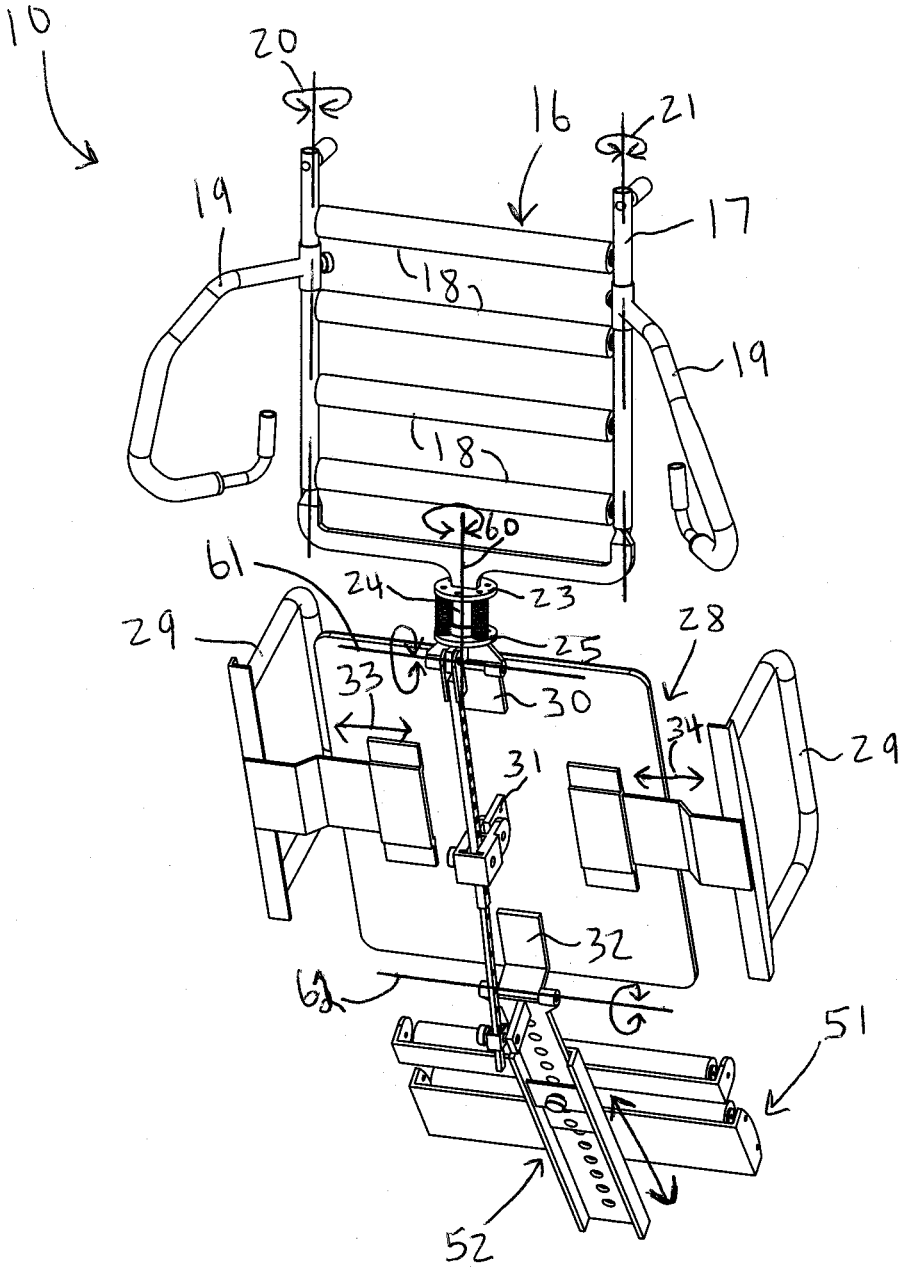
FIG. 2 is a perspective view showing the rear side of the exercise device of FIG. 1.
Figure 3:
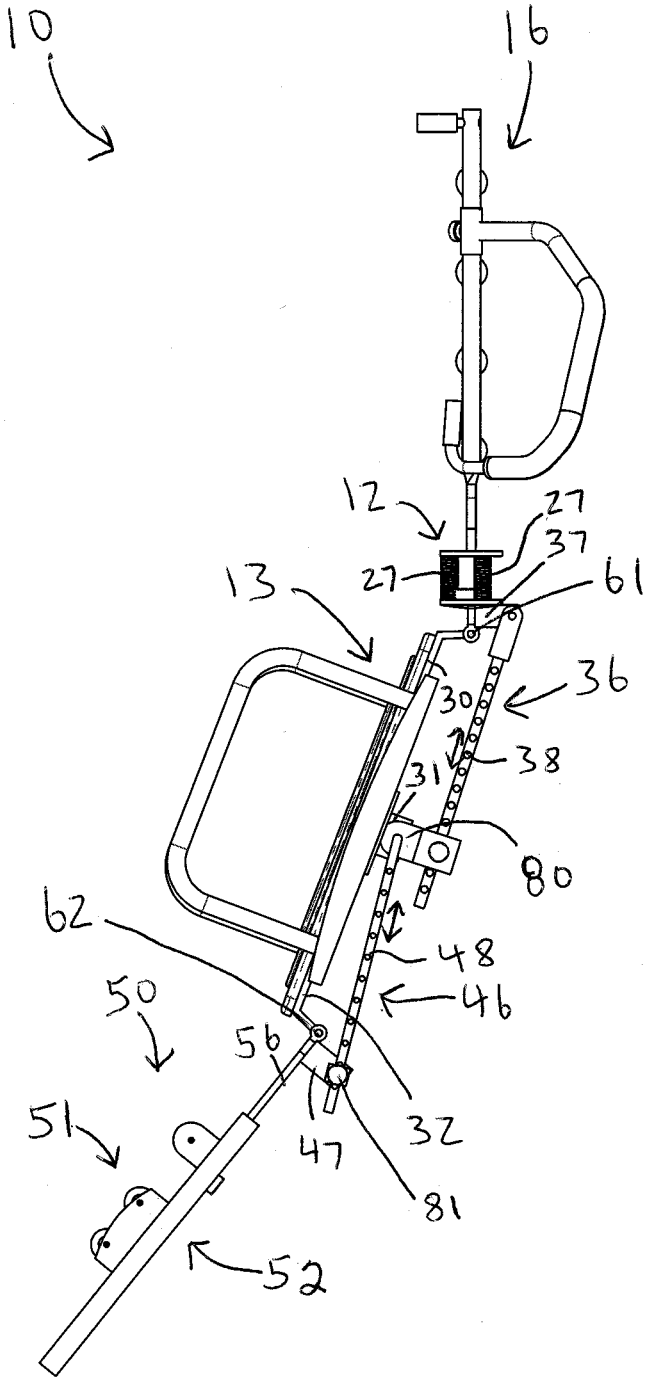
FIG. 3 is a side elevational view of the exercise device shown in FIG. 1.
Figure 4:
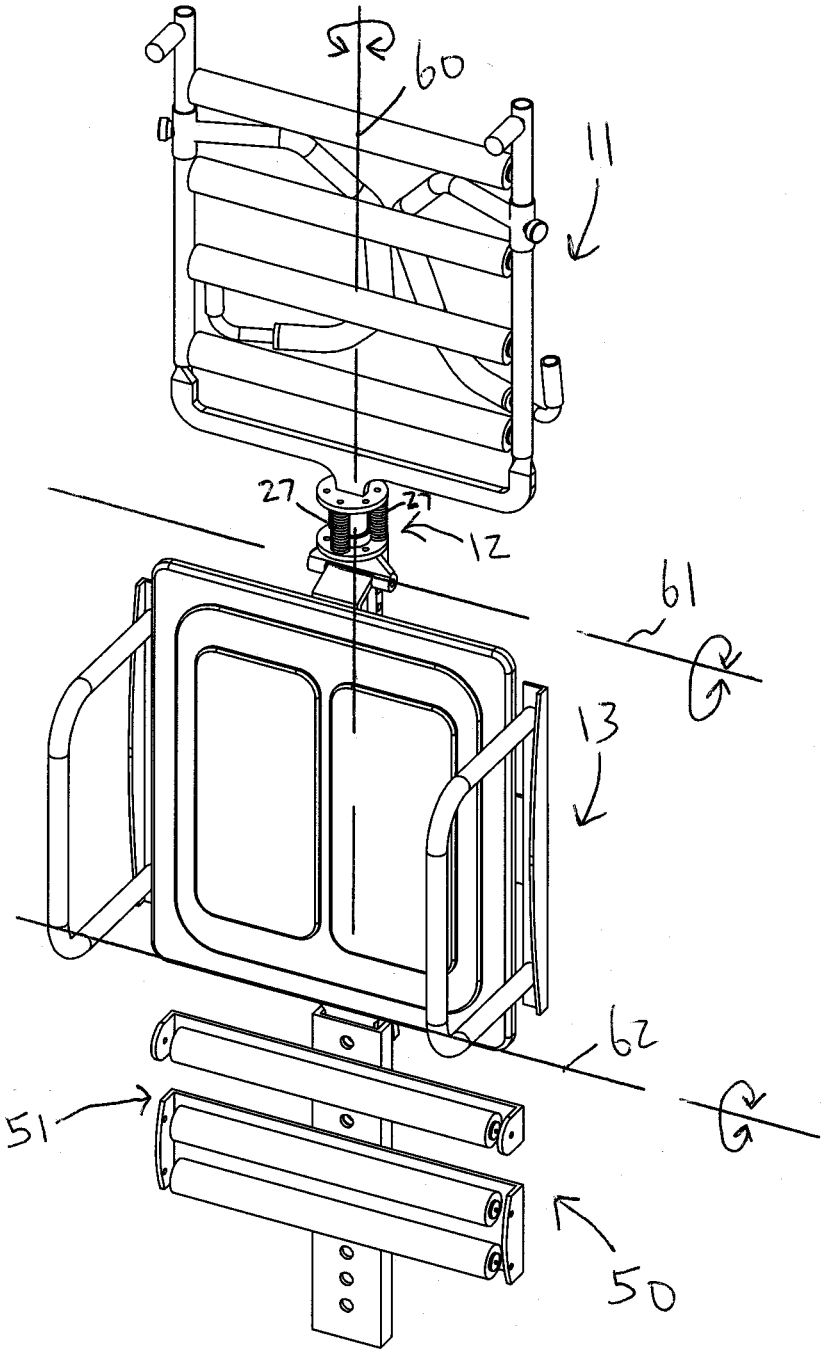
FIG. 4 is a perspective view showing a front side of the exercise device at a retracted configuration.
Figure 5:
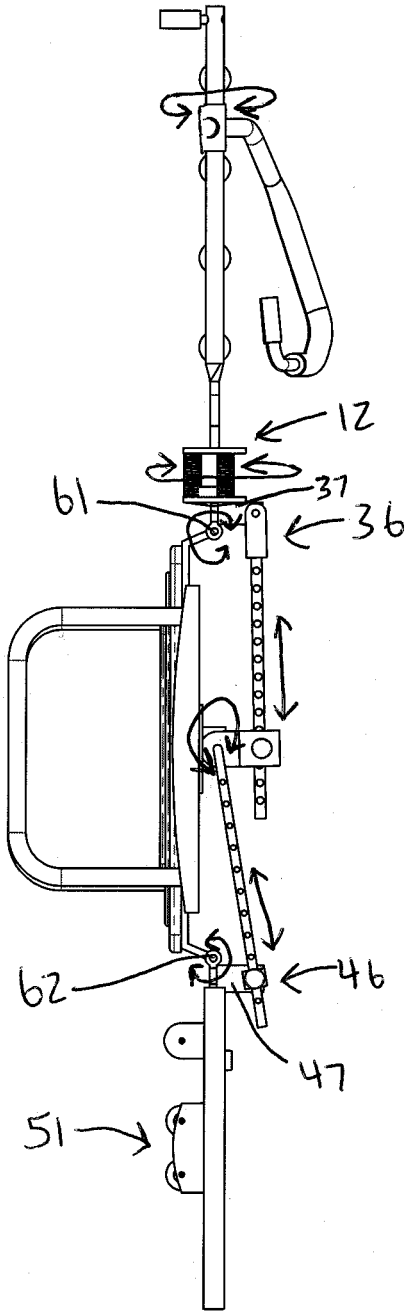
FIG. 5 is a side elevational view of the exercise device shown in FIG. 4.
Figure 6:
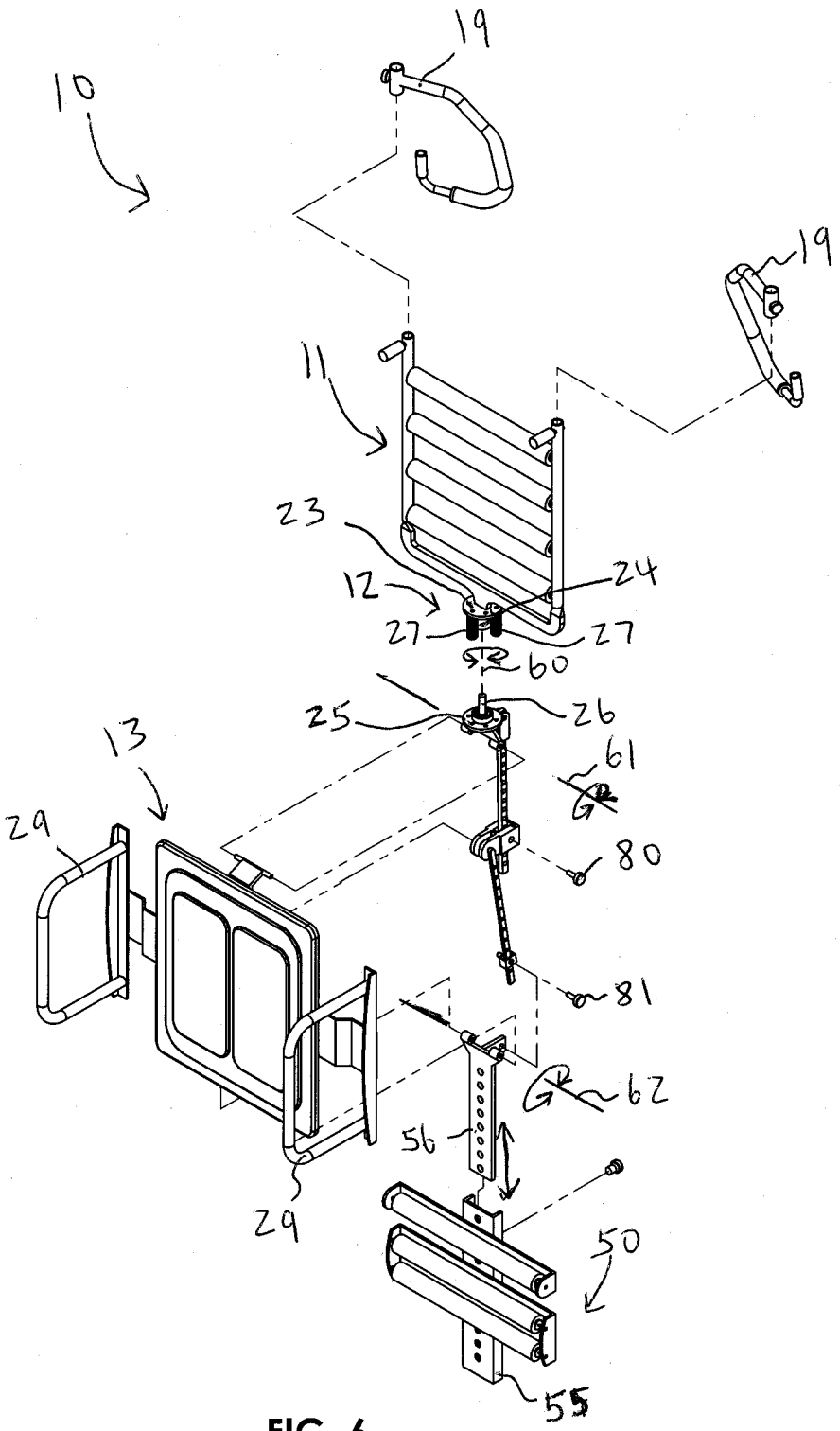
FIG. 6 is an exploded view of the exercise device shown in FIG. 4.

The non-limiting exemplary embodiment(s) is/are referred to generally in FIGS. 1-6 and is/are intended to provide a multi-functional and collapsible exercise device 10 that can be assembled in a variety of configurations for facilitating a variety of targeted exercises. It should be understood that the exemplary embodiment may be used in many different configurations, and should not be limited to any particular configuration described herein.

Referring to FIGS. 1-6, the multi-functional exercise device 10 can be maneuvered between a variety of configurations for facilitating a variety of targeted exercises includes a top section 11, a torque manipulator 12 adjustably attached to the top section 11, and an intermediate section 13 adjustably attached to the torque manipulator 12. Advantageously, the torque manipulator 12 causes greater (rotational) resistance to rotational movement of the top section 11 relative to the intermediate section 13 when the top section 11 is rotated, along a first rotation direction 14 (about first axis 60), from a rested equilibrium position (when the top section 11 is substantially faces a same direction as intermediate section 13) to a displaced tensioned position (when the top section 11 is faces a different direction from intermediate section 13 (e.g., twisted about first axis 60; offset from a direction in which intermediate section 13 is facing). Advantageously, the torque manipulator 12 causes lesser resistance to rotational movement of the top section 11 relative to the intermediate section 13 when the top section 11 is rotated, along a second rotation direction 15 (about first axis 60), from the displaced tensioned position to the rested equilibrium position (e.g., top section 11 returning back to a forward facing direction that is the same as the intermediate section 13).

In a non-limiting exemplary embodiment, the top section 11 includes a back rest 16 including a frame 17, a plurality of bars 18 rotatably affixed to the frame 17, and a plurality of top handles 19 rotatably mated to the frame 17. Such top handles 19 are selectively articulated along mutually exclusive arcuate paths 20, 21 located at lateral sides of the frame 17.

In a non-limiting exemplary embodiment, the torque manipulator 12 includes a dynamic top bracket 23 having a female socket 24 extending downwardly therefrom, a static bottom bracket 25 having a male shaft 26 extending upwardly therefrom, and a plurality of helical springs 27 equidistantly offset from the female socket 24. In this manner, each of the helical springs 27 has opposed top and a bottom ends fixedly attached to the top bracket 23 and the bottom bracket 25, respectively. Advantageously, the helical springs 27 are simultaneously biased (e.g., twisted, tensioned, etc.) and released (e.g. rotated towards equilibrium) as the top bracket 23 is articulated, along the first rotation direction 14 (e.g., rotated away from equilibrium) and the second rotation direction 15 (e.g. released), about first axis 60 passing through the bottom bracket 25.

In a non-limiting exemplary embodiment, the helical springs 27 are extended (e.g., longitudinal length of springs increases) when biased to the displaced tensioned position and retracted (e.g., longitudinal length of springs decreases) when released to the rested equilibrium position.

In a non-limiting exemplary embodiment, the intermediate section 13 includes a seat rest 28, a plurality of intermediate handles 29 frictionally engaged with the seat rest 28, a first anchor bracket 30 fixedly secured to an upper portion of a rear side of the seat rest 28, a second anchor bracket 31 fixedly secured to a medial portion of the rear side of the seat rest 28, and a third anchor bracket 32 fixedly secured to a lower portion of the rear side of the seat rest 28. Such intermediate handles 29 are linearly displaced along mutually exclusive linear paths 33, 34 extending laterally away from the seat rest 28.

In a non-limiting exemplary embodiment, the intermediate section 13 further includes a first angularly adjustable mechanism 36 coupled to the torque manipulator 12, the first anchor bracket 30 and the second anchor bracket 31.

In a non-limiting exemplary embodiment, the first angularly adjustable mechanism 36 includes a first bracket 37 hingedly coupled to the first anchor bracket 30 and statically coupled to the torque manipulator 12, and a first linear guide rail 38 statically mated to the first bracket 37 and extending outwardly therefrom. Notably, the first linear guide rail 38 is adjustably mated to the second anchor bracket 31.

In a non-limiting exemplary embodiment, the intermediate section 13 further includes a second angularly adjustable mechanism 46 coupled to the second anchor bracket 31 and the third anchor bracket 32.

In a non-limiting exemplary embodiment, multi-functional exercise device 10 further includes a bottom section 50 adjustably attached to the intermediate section 13.

In a non-limiting exemplary embodiment, the bottom section 50 includes a foot rest 51 including a linearly adjustable mechanism 52 operably connection to the second angularly adjustable mechanism 46.

In a non-limiting exemplary embodiment, the linearly adjustable mechanism 52 includes a linear female section 55, a linear male section 56 telescopically engaged with the linear female section 55, and a leg bar frame 57 having a plurality of offset horizontal cylindrical sections 58 attached thereto. Notably, the leg bar frame 57 is coupled to the linear female section 55.

In a non-limiting exemplary embodiment, the second angularly adjustable mechanism 46 includes a second bracket 47 hingedly coupled to the third anchor bracket 32 and the linear male section 56, and a second linear guide rail 48 adjustably mated to the second bracket 47 and extending outwardly therefrom. Notably, the second linear guide rail 48 is pivotally mated to the second anchor bracket 31. Suitable fasteners 80, 81 maintain the top and bottom ends of the linear guide rail 48 fixedly engaged at a desired angle relative to the second anchor bracket 31 and second bracket 47.

In a non-limiting exemplary embodiment, the first angularly adjustable mechanism 36 causes the back rest 16 to articulate, relative to the intermediate section 13, about a second axis 61 disposed perpendicular to the first axis 60.

In a non-limiting exemplary embodiment, the second angularly adjustable mechanism 46 causes the foot rest 51 to articulate, relative to the back rest 16, about a third axis 62 disposed perpendicular to the first axis 60 and parallel to the second axis 61.

The present disclosure further includes a method of utilizing a multi-functional exercise device 10 that can be maneuvered between a variety of configurations for facilitating a variety of targeted exercises. Such a method includes the steps of: providing a top section 11; providing and adjustably attaching a torque manipulator 12 to the top section 11; and providing and adjustably attaching an intermediate section 13 to the torque manipulator 12. The method further includes the steps of: the torque manipulator 12 causing greater resistance to rotational movement of the top section 11 relative to the intermediate section 13 when the top section 11 is rotated, along a first rotation direction 14, from a rested equilibrium position to a displaced tensioned position; and the torque manipulator 12 causing lesser resistance to rotational movement of the top section 11 relative to the intermediate section 13 when the top section 11 is rotated, along a second rotation direction 15, from the displaced tensioned position to the rested equilibrium position.

Referring to the figures in general, in a non-limiting exemplary embodiment, a multi-functional and collapsible exercise device 10 is assembled in a variety of configurations for facilitating a variety of targeted exercises. The multi-functional and collapsible exercise device 10 provides a variety of different attachments designed to enable alternate configurations. The result is a versatile product that can be assembled in a variety of different manners and used to accelerate one's development in a number of different targeted exercises, yet which still collapses and folds away into a compact package capable of easy storage in a closet or under a bed.

In a non-limited exemplary embodiment, the multi-functional and collapsible exercise device 10 includes many different pieces that can be assembled together into a variety of different forms, depending on which muscle groups the user wishes to condition. There can be three structural elements that represent the core of the device 10. These include the back rest 11, the seat rest 28 and the leg bars 51. The back rest 16 and seat rest 28 are both constructed out of heavy steel supporting members with vinyl-faced and foam padded protective seating affixed over-top. The two can be connected together at any angle, as best fits the physiology of the user and the muscle groups to be targeted. They are affixed to one another by a torque manipulator 12, a multi-angle heavy-duty fitting that allows them to be positioned in place and then locked there. The leg bars 51, or foot locker (e.g., foot rest), include three horizontal cylindrical sections 58 of steel pipe, each effectively padded with a layer of dense foam. These three pipe sections are secured to a heavy metal frame 57, which keeps them in the ideal position for supporting the user's shins and ankles during the workout. The level of each bar can be manually adjusted, to ensure a perfect fit for users of all sizes. The leg bar frame 57 secures directly to two stainless steel gripping handles 29, each affixed to either side of the seat rest 28. These handles 29 are articulated, allowing the user to raise them up or lower them down when setting the device 10 in one mode or another, and then secure them in place at the ideal angle.

In a non-limited exemplary embodiment, the multi-functional and collapsible exercise device 10 rests on a pair of steel stands that elevated it up off the floor, providing some small clearance to help the user feel elevated. It also includes tension bands, which the user can affix to various points on the frame 57 itself, to either provide a light mechanical assistance, or increase the tension and therefore the difficulty associated with each of the available exercise modes.

Using the multi-functional and collapsible exercise device 10 is a relatively simple affair. First, the device 10 must be assembled, with the back and seat set at the correct angle to properly support the user's frame, and the foot locking leg bars 51 attached, also set to the correct dimension to accommodate the user. The handles on the device's side should be set to a comfortable angle, and the tension bands may be applied, should the user desire either mechanical assistance or increased mechanical tension.

Once the device 10 has been un-boxed, assembled and set to the correct proportions, the user should secure him in place atop the device 10. This involves reclining on the back and seat supports, and threading one's legs between the various leg bars 51 in the foot locker, so as to ensure their immobility. Once the legs are securely in place, the exercise routine can begin. This includes performing various crunches and curls, drawing the upper torso forward and targeting the muscles on the wall of the abdominal cavity. Extra support from the side handles can be applied to assist the user in working left and right as well as back and forth, thereby fully developing the whole spectrum of muscle tissues in the targeted group.

The multi-functional and collapsible exercise device 10 offers users a significant usability advantage over other currently available workout machines designed to target the abdominal area. It is compact and relatively light weight, and comes apart easy for storage in a bedroom closet or underneath the bed itself. The various user-adjustable elements ensure that it can be assembled in a manner that's proper for users of any body type, and its robust construction and heavy-duty members ensure that it will perform well for years to come. Integrated tension bands allow for further customization of the resistance settings, and the entire device 10 makes the simple act of working out that much more effective and rewarding.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed is:

1. A multi-functional exercise device that can be maneuvered between a variety of configurations for facilitating a variety of targeted exercises, said multi-functional exercise device comprising:

a top section;

a torque manipulator attached to said top section; and an intermediate section attached to said torque manipulator;

wherein said torque manipulator causes greater resistance to rotational movement of said top section relative to said intermediate section when said top section is rotated, along a first rotational direction, from a rested equilibrium position to a displaced tensioned position;

wherein said torque manipulator causes lesser resistance to rotational movement of said top section relative to said intermediate section when said top section is rotated, along a second rotational direction, from said displaced tensioned position to said rested equilibrium position;

wherein said top section includes a back rest having a frame, a plurality of bars rotatably affixed to said frame, and a plurality of top handles rotatably mated to said frame;

wherein said plurality of top handles are selectively articulated along mutually exclusive arcuate paths located at lateral sides of said frame;

wherein said torque manipulator includes a dynamic top bracket having a female socket extending downwardly therefrom, a static bottom bracket having a male shaft extending upwardly therefrom, and a plurality of helical springs equidistantly offset from said female socket;

wherein each of said plurality of helical springs has opposed top and a bottom ends fixedly attached to said top bracket and said bottom bracket, respectively;

wherein said plurality of helical springs are simultaneously biased and released as said top bracket is articulated, along said first rotational direction and said second rotational direction, about a first axis passing through said bottom bracket.

2. The multi-functional exercise device of claim 1, wherein said intermediate section comprises:

a seat rest;

a plurality of intermediate handles frictionally engaged with said seat rest;

a first anchor bracket fixedly secured to an upper portion of a rear side of said seat rest;

a second anchor bracket fixedly secured to a medial portion of said rear side of said seat rest; and a third anchor bracket fixedly secured to a lower portion of said rear side of said seat rest;

wherein said intermediate handles are linearly displaced along mutually exclusive linear paths extending laterally away from said seat rest.

3. The multi-functional exercise device of claim 2, wherein said intermediate section further comprises: a second angularly adjustable mechanism coupled to said second anchor bracket and said third anchor bracket.

4. The multi-functional exercise device of claim 3, further comprising: a bottom section adjustably attached to said intermediate section.

5. The multi-functional exercise device of claim 4, wherein said bottom section comprises:

a foot rest including a linearly adjustable mechanism operably connection to said second angularly adjustable mechanism.

6. The multi-functional exercise device of claim 5, wherein said linearly adjustable mechanism comprises:

a linear female section;

a linear male section telescopically engaged with said linear female section; and a leg bar frame having a plurality of offset horizontal cylindrical sections attached thereto;

wherein said leg bar frame is coupled to said linear female section.

7. The multi-functional exercise device of claim 6, wherein said second angularly adjustable mechanism comprises:

a second bracket hingedly coupled to said third anchor bracket and said linear male section; and a second linear guide rail adjustably mated to said second bracket and extending outwardly therefrom;

wherein said second linear guide rail is pivotally mated to said second anchor bracket.

8. The multi-functional exercise device of claim 7, wherein said first angularly adjustable mechanism causes said back rest to articulate, relative to said intermediate section, about a second axis disposed perpendicular to said first axis.

9. The multi-functional exercise device of claim 8, wherein said second angularly adjustable mechanism causes said foot rest to articulate, relative to said back rest, about a third axis disposed perpendicular to said first axis and parallel to said second axis.

10. The multi-functional exercise device of claim 2, wherein said intermediate section further comprises: a first angularly adjustable mechanism coupled to said torque manipulator, said first anchor bracket and said second anchor bracket.

11. The multi-functional exercise device of claim 10, wherein said first angularly adjustable mechanism comprises:

a first bracket hingedly coupled to said first anchor bracket and statically coupled to said torque manipulator; and a first linear guide rail statically mated to said first bracket and extending outwardly therefrom;

wherein said first linear guide rail is adjustably mated to said second anchor bracket.

12. The multi-functional exercise device of claim 1, wherein said plurality of helical springs are extended when biased to said displaced tensioned position and retracted when released to said rested equilibrium position.

13. A multi-functional exercise device that can be maneuvered between a variety of configurations for facilitating a variety of targeted exercises, said multi-functional exercise device comprising:

a top section;

a torque manipulator adjustably attached to said top section; and an intermediate section adjustably attached to said torque manipulator;

wherein said torque manipulator causes greater resistance to rotational movement of said top section relative to said intermediate section when said top section is rotated, along a first rotational direction, from a rested equilibrium position to a displaced tensioned position;

wherein said torque manipulator causes lesser resistance to rotational movement of said top section relative to said intermediate section when said top section is rotated, along a second rotational direction, from said displaced tensioned position to said rested equilibrium position;

wherein said top section includes a back rest having a frame, a plurality of bars rotatably affixed to said frame, and a plurality of top handles rotatably mated to said frame;

wherein said plurality of top handles are selectively articulated along mutually exclusive arcuate paths located at lateral sides of said frame;

wherein said torque manipulator includes a dynamic top bracket having a female socket extending downwardly therefrom, a static bottom bracket having a male shaft extending upwardly therefrom, and a plurality of helical springs equidistantly offset from said female socket;

wherein each of said plurality of helical springs has opposed top and a bottom ends fixedly attached to said top bracket and said bottom bracket, respectively;

wherein said plurality of helical springs are simultaneously biased and released as said top bracket is articulated, along said first rotational direction and said second rotational direction, about a first axis passing through said bottom bracket.

14. A method of utilizing a multi-functional exercise device that can be maneuvered between a variety of configurations for facilitating a variety of targeted exercises, said method comprising the steps of:

providing a top section;

providing and adjustably attaching a torque manipulator to said top section;

providing and adjustably attaching an intermediate section to said torque manipulator;

said torque manipulator causing greater resistance to rotational movement of said top section relative to said intermediate section when said top section is rotated, along a first rotational direction, from a rested equilibrium position to a displaced tensioned position; and said torque manipulator causing lesser resistance to rotational movement of said top section relative to said intermediate section when said top section is rotated, along a second rotational direction, from said displaced tensioned position to said rested equilibrium position;

wherein said top section includes a back rest having a frame, a plurality of bars rotatably affixed to said frame, and a plurality of top handles rotatably mated to said frame;

wherein said plurality of top handles are selectively articulated along mutually exclusive arcuate paths located at lateral sides of said frame;

wherein said torque manipulator includes a dynamic top bracket having a female socket extending downwardly therefrom, a static bottom bracket having a male shaft extending upwardly therefrom, and a plurality of helical springs equidistantly offset from said female socket;

wherein each of said plurality of helical springs has opposed top and a bottom ends fixedly attached to said top bracket and said bottom bracket, respectively;

wherein said plurality of helical springs are simultaneously biased and released as said top bracket is articulated, along said first rotational direction and said second rotational direction, about a first axis passing through said bottom bracket.

* * * * *